US011904222B2

(12) United States Patent
Paulsen

(10) Patent No.: US 11,904,222 B2
(45) Date of Patent: Feb. 20, 2024

(54) ADJUSTABLE RESISTANCE APPARATUS AND RELATED METHODS

(71) Applicant: Logan Paulsen, Ashburn, VA (US)

(72) Inventor: Logan Paulsen, Ashburn, VA (US)

( * ) Notice: Subject to any disclaimer, the term of this patent is extended or adjusted under 35 U.S.C. 154(b) by 96 days.

(21) Appl. No.: 17/667,723

(22) Filed: Feb. 9, 2022

(65) Prior Publication Data

US 2022/0339518 A1 Oct. 27, 2022

Related U.S. Application Data

(60) Provisional application No. 63/150,562, filed on Feb. 17, 2021.

(51) Int. Cl.

| | |
|---|---|
| ***A63B 71/00*** | (2006.01) |
| ***A63B 21/018*** | (2006.01) |
| ***A63B 21/00*** | (2006.01) |

(52) U.S. Cl.

CPC .... *A63B 71/0054* (2013.01); *A63B 21/00069* (2013.01); *A63B 21/018* (2013.01); *A63B 2071/009* (2013.01)

(58) Field of Classification Search

CPC ..... A63B 71/0054; A63B 21/00069; A63B 21/018; A63B 2071/009; A63B 2209/02

See application file for complete search history.

(56) References Cited

U.S. PATENT DOCUMENTS

| | | | | | |
|---|---|---|---|---|---|
| 3,411,776 | A * | 11/1968 | Holkesvick | A63B 21/018 | 242/153 |
| 3,782,722 | A * | 1/1974 | Webb | A63B 21/00069 | 188/65.1 |
| 4,027,876 | A * | 6/1977 | Johnston | A63B 21/00069 | 242/154 |
| 4,040,627 | A * | 8/1977 | Useldinger | A63B 21/00069 | 188/65.4 |
| 4,294,446 | A * | 10/1981 | Moore | A63B 21/018 | 116/282 |
| 4,560,160 | A * | 12/1985 | Smith | A63B 21/018 | 482/55 |
| 5,352,172 | A * | 10/1994 | Suzaki | A63B 21/018 | 182/5 |
| 5,656,004 | A * | 8/1997 | Useldinger | A63B 21/018 | 482/114 |
| 6,102,837 | A * | 8/2000 | Hubbard | A63B 21/018 | 482/114 |
| 7,090,622 | B2 * | 8/2006 | Hetrick | A63B 23/16 | 482/141 |
| 7,291,099 | B1 * | 11/2007 | Marczewski | A63B 21/00069 | 482/148 |
| 9,764,177 | B2 * | 9/2017 | Baudhuin | A63B 23/1209 | |
| 2013/0296146 | A1 * | 11/2013 | Staten | A63B 21/154 | 482/120 |

* cited by examiner

*Primary Examiner* — Andrew S Lo

(74) *Attorney, Agent, or Firm* — Captial Patent & Trademark Law Firm, PLLC

(57) ABSTRACT

An adjustable resistance apparatus includes features that protect a user from harmful heat generated during use while offering a wide range of resistances. The apparatus may be combined with a variety of accessories, such as a load cell.

17 Claims, 18 Drawing Sheets

*FIG. 2* A
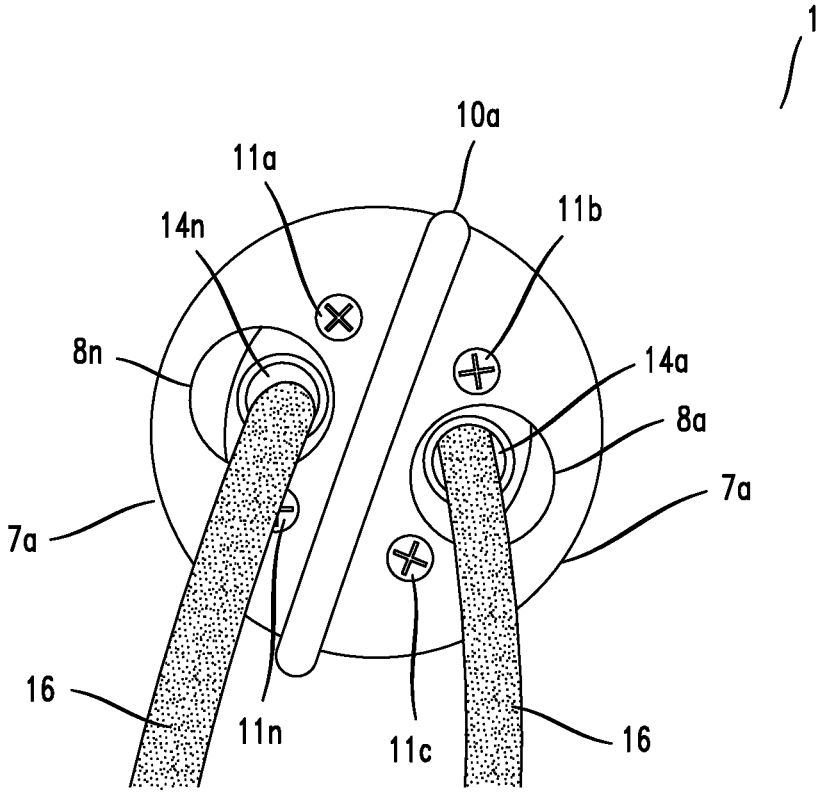

*FIG.* 6B
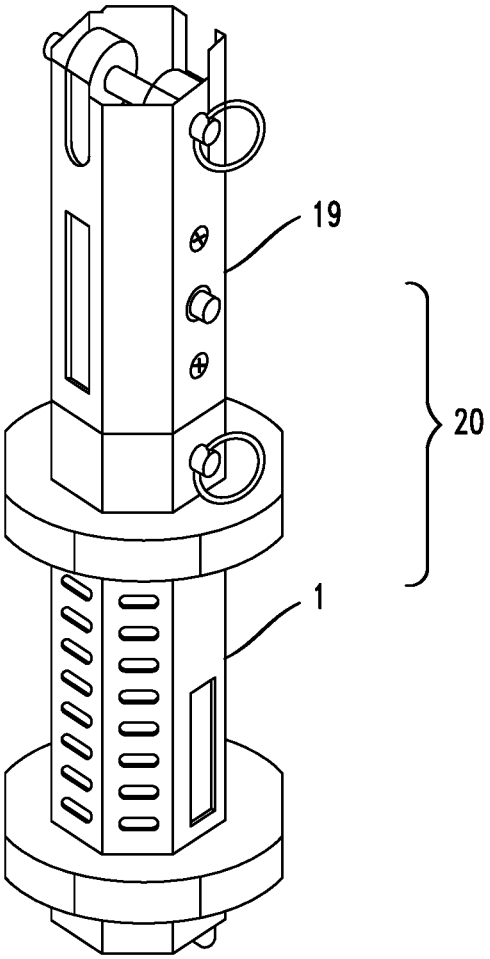

ADJUSTABLE RESISTANCE APPARATUS AND RELATED METHODS

CROSS-REFERENCE TO RELATED APPLICATION

This application claims priority to U.S. Provisional Application 63/150,562 filed Feb. 17, 2021, the disclosure of which is incorporated herein by reference in its entirety.

INTRODUCTION

This section introduces aspects that may be helpful to facilitate a better understanding of the present disclosure. Accordingly, the statements in this section are to be read in this light and are not to be understood as admissions about what is, or what is not, in the prior art.

There is a need to provide an apparatus that can be used in conjunction with a rope or other similar material during fitness training (to name one example of the apparatus' commercial usage). This need is motivated by many factors, included among them is that an individual utilizing an existing apparatus is not protected from heat that builds up as the rope—under tension—passes through, and makes contact with the apparatus. In some cases the heat that builds up may prevent the individual from touching the apparatus to adjust the tension of the rope, for example. Other times the heat may injure the individual. Still other times the heat may degrade the rope.

Accordingly, it is desirable to provide an apparatus and related methods that overcomes disadvantages of existing apparatuses, some of which are described above.

BRIEF DESCRIPTION OF DRAWINGS

FIGS. 2A to 2C depict different views of an exemplary, inventive apparatus or components thereof with a rope positioned there through according to exemplary embodiments.

FIG. 4A depicts an exemplary shape of an end of an exemplary, inventive apparatus according to an embodiment while

FIGS. 6A to 6F depict an exemplary load cell, an exemplary combination of a load cell and an inventive apparatus, and elements of such an exemplary combination, respectively.

SUMMARY

Figure 1A:
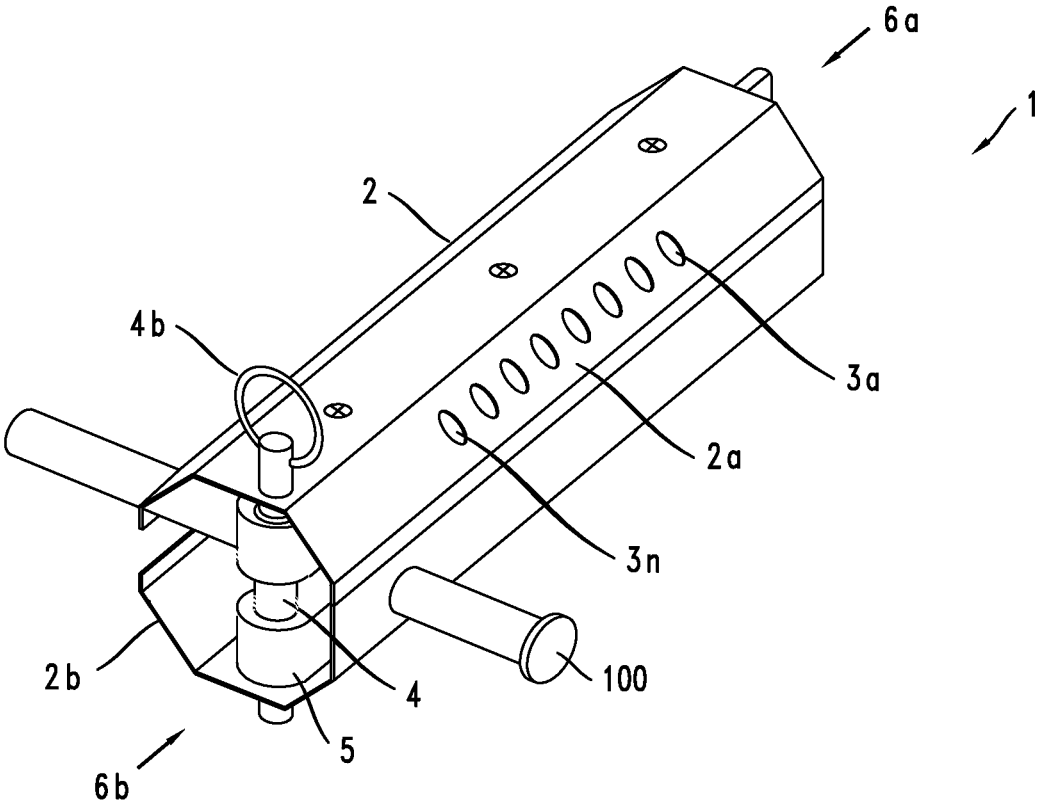
FIG. 1A includes a depiction of an exemplary, inventive apparatus according to an embodiment.

The inventor provides a number of inventive, adjustable tension and resistance apparatuses and related methods. For example, one such apparatus may comprise a cage that may be configured to protect an individual who is using the apparatus (i.e., a user) in conjunction with a rope from, among other things, thermal energy (i.e., heat) emanating from internal components within the cage that are warmed or heated as the rope under tension makes contact with such internal components. In an embodiment, the inventive cage may comprise two portions that may be configured such that each portion slidably mates with the other, for example, and be configured in a substantially octagon shape but this is merely exemplary (i.e., the cage may be configured in a number of different shapes).

Each portion of the cage may comprise one or more openings, where each opening may be configured to allow thermal energy (e.g., heat) to exit from components within the cage to allow heat to escape rather than flow to components of the apparatus. This reduces the chances that a user may be harmed by touching the apparatus. The inventor further believes that by allowing heat to escape the lifetime of the rope can be extended.

In embodiments, the cage portions may be composed of an aluminum (e.g., aluminum 6061), or a carbon fiber, for example.

An inventive apparatus may include many inventive features discussed in more detail elsewhere herein. Some of the features include, but are not limited to: (i) configuring an end cover that is secured to a fair lead by using one or more fasteners and separator structures to maintain space between the fair lead and cover to reduce the likelihood that the cover interferes with the operation of the fair lead when adjusting tension on a rope; (ii) inclusion of a mandrel that is connected to the fair lead, where the mandrel comprises sides that are substantially flat or level to allow ease of manufacture and assembly; and (iii) inclusion of insulating and fixation components that are configured to connect the cage to internal components and for restricting or fixing the movement of such internal components within the cage, where each insulating and fixation component may be configured with a few number of protrusions that make physical contact with the cage at a few points of contact. Because there are few points of contact the flow of heat from internal components to the cage may be reduced.

Additional features of an exemplary, inventive apparatus may include: (iv) an indicator for indicating an amount of tension or resistance applied (or not) to the rope by the inventive apparatus; (v) a cover that comprises openings having a diameter larger than corresponding openings in the fair lead to allow for passage of a rope there through such that the chances that the rope will make contact with the inside perimeter of the openings in the cover as the rope passes through to the fair lead are reduced; (vi) configuring the fair lead such that it can moved (e.g., rotated) either clockwise or counterclockwise to help reduce the wear and tear, and therefore, extend the useful life of, the fair lead;

(vii) inclusion of a tension adjustment feature that includes the combination of an adjustable plate having a plurality of adjustment grooves and a bolt with a plurality of adjustment edges that fit into one or more of the grooves for adjusting the tension to be applied to the rope and, therefore, the resistive force applied to a user of the apparatus as well; (viii) inclusion of a handle that is configured to limit the amount of heat that may be conducted to the handle from internal components and/or the rope, and that is positioned such that it does not block or interfere with the path of a rope; (ix) an exemplary handle that may be composed of an aluminum, or, alternatively, of an insulating material, such as a Delrin® plastic; (x) configuring a shackle with a gap denoted "g" between forked sections of the shackle to allow for insertion of a desired-sized webbing without the webbing getting bunched; (xi) configuring a shackle and dowel to provide a far simpler design for connecting or attaching accessories or for anchoring the apparatus; (xii) configuring the forked sections of the shackle with substantially flat, internal and external surfaces denoted to allow for efficient extrusion of the shackle as it is manufactured without having to re-position the shackle, which may also reduce the amount of time and money needed to produce an inventive apparatus; (xiii) configuring an end of the apparatus in a shape that allows a shackle to be more readily assembled; (xiv) inclusion of a fastener system for connecting accessories; and (xv) inclusion of one or more protective components, each positioned, for example, at one end of the apparatus to absorb and/or deflect forces that would otherwise be applied to the apparatus should the apparatus make contact with a rough surface (e.g., a sidewalk, pavement, floor), for example.

Still further, an inventive apparatus may be connected to a load cell to form an exemplary system.

In addition to the apparatuses described above, the present disclosure also provides corresponding related methods that make use of the inventive apparatuses.

DETAILED DESCRIPTION, WITH EXAMPLES

Exemplary embodiments of adjustable, resistance apparatuses and related methods are described herein and are shown by way of example in the drawings. Throughout the following description and drawings, like reference numbers/characters refer to like elements.

It should be understood that although specific embodiments are discussed herein, the scope of the disclosure is not limited to such embodiments. On the contrary, it should be understood that the embodiments discussed herein are for illustrative purposes, and that modified and alternative embodiments that otherwise fall within the scope of the disclosure herein are contemplated.

As used herein, the words "comprising", and any form thereof such as "comprise" and "comprises"; "having", and any form thereof such as "have" and "has"; "including", and any form thereof such as "includes" and "include"; and "containing" and any form thereof such as "contains" and "contain" are inclusive or open-ended and do not exclude additional, unrecited elements or process steps.

As used herein, the term "a" or "an" may mean "one", but is also consistent with the meaning of "one or more", "at least one", and "one or more than one".

It should also be understood that one or more exemplary embodiments may be described and/or illustrated as a process or method. Although a process/method may be described and/or illustrated as sequential, it should be understood that such a process/method may be performed in parallel, concurrently or simultaneously. In addition, the order of each step within a process/method may be rearranged. A process/method may be terminated when completed and may also include additional steps not included in a description and/or illustration of the process/method.

As used herein, the term "and/or" includes any and all combinations or permutations of one or more of the associated listed items.

It should be understood that when used herein, the designations "first", "second", "third", etc., are purely to distinguish one component or element of a system or apparatus, part of a process from another and does not indicate an importance, priority or status unless the context, common sense or recognized knowledge of those skilled in the art indicate otherwise. In fact, in some cases the component or elements of a process could be re-designated (i.e., renumbered) and it would not affect the scope of the present disclosure.

As used herein the phrase "end" may connote the relative position of an element or component of an inventive apparatus from the center of an inventive apparatus. For example, if an "end" is described as a "top" (or "bottom") end, and the end is then re-oriented, then the end may be described by the opposite nomenclature—"bottom" end (or "top" end as the case may be).

It should be understood that when one component of an exemplary, inventive apparatus is described or depicted as being "connected" to another component, other components used to facilitate such a connection may not be described or depicted because such components are well known to those skilled in the art.

Yet further, when one component of an exemplary, inventive apparatus is described or depicted as being connected to another component in a figure it should be understood that practically speaking such a connection may comprise (and many times will comprise) more than one physical connection.

It should be noted that the exemplary, inventive apparatuses, as well as any components, or elements thereof, illustrated in the figures are not necessarily drawn to scale, and need not be representative of an actual shape or size and need not be representative of any actual device. Rather, the exemplary, inventive apparatuses, components and elements are drawn so as to help explain the features, functions and processes of various exemplary embodiments of the present disclosure described herein.

Relatedly, to the extent that any of the figures or text included herein depicts or describes dimensions or operating parameters it should be understood that such information is merely exemplary and non-limiting, and is provided to enable one skilled in the art to make and use an exemplary embodiment of the present disclosure without departing from the scope of the disclosure.

Where used herein, the letter "n" may denote the last component of one or more components (e.g., openings 3*a* to 3*n*).

As used herein, the terms "embodiment" or "exemplary" refer to a non-limiting example of the present disclosure.

Referring now to FIG. 1A there is depicted an exemplary, inventive apparatus 1 according to an embodiment of the disclosure that may be used in conjunction with an accessory 100. Exemplary apparatus 1 may comprise a cage 2 that is configured to protect an individual who is using the apparatus 1 in conjunction with a rope (not shown in FIG. 1A; but see element 16 in FIG. 2A) from, among other things, heat emanating from components within the cage 2 that are warmed or heated as the rope under tension makes contact with such components. In an embodiment, the cage 2 may be configured in a substantially octagonal shape but this is merely exemplary (i.e., the cage may be configured in a number of different shapes).

In one embodiment the cage 2 may comprise two portions (e.g., a top 2*a* and bottom 2*b* portion) that may be configured such that each slidably mates with the other, for example, though it should be understood that in an alternative embodiment, the cage 2 may be connected in a different configuration or may be a single unitary component.

Continuing, in more detail cage portions 2*a*, 2*b* may be composed of an aluminum (e.g., aluminum 6061) or another material having at least similar or better characteristics as aluminum (e.g., a carbon fiber, Delrin® plastic). Further, each cage portion 2*a*, 2*b* may be coated with one or more layers of a finishing coating, such as a powder coating for example.

In an embodiment, the bottom portion 2*b* (or top portion 2*a*) may be slidably inserted within the top portion 2*a* (or bottom portion 2*b*), for example. Advantageously, such a slidable connection of components minimizes the need to use additional connection components (e.g., fasteners) making assembly by a user straightforward and may also lead to a reduction in manufacturing costs. Yet further, because the cage portions 2*a*, 2*b* can be slidably disconnected without the need to utilize additional tools/parts (e.g., to unscrew nuts, bolts), if an internal component of the apparatus 1 or the rope needs to be removed, cleaned or repaired, the internal component or rope can be accessed more rapidly than if such additional tools were required.

In one embodiment, the top and bottom portions 2*a*, 2*b* may be configured to be symmetrical-shaped when compared to one another, for example.

Each portion 2*a*, 2*b* may comprise one or more openings 3*a* to 3*n* (where "n" denotes the last opening; only the openings in portion 2*a* are shown in FIG. 1A), where each opening 3*a* to 3*n* in each portion 2*a*, 2*b* may be configured to allow thermal energy in the form of heat to exit from components within the cage 2 (hereafter such components may be referred to as "internal components"). In an embodiment, portions of a dowel 4 and shackle 5 configuration may emanate such heat.

It should be noted that in FIG. 1A, the end cover for end 6*b* has been removed to view the shackle 5 and dowel 4 configuration. Further, FIG. 1A illustrates how an accessory 100 may be held by the dowel 4 and shackle 5 configuration of the apparatus 1, though it should be noted that the accessory 100 need not be included in the apparatus 1 and may be held by alternative components other than a dowel and shackle.

Figure 1B:
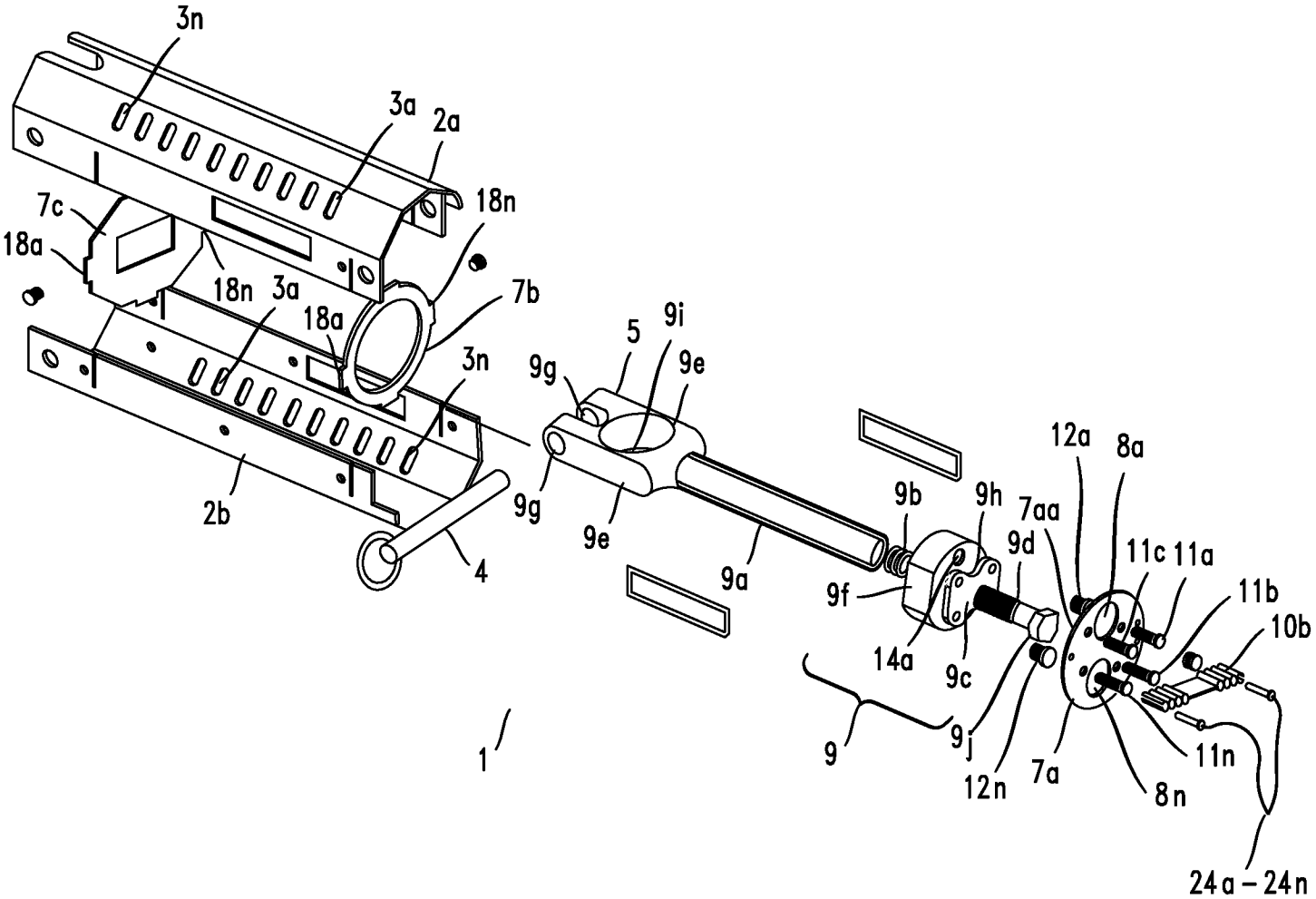
FIG. 1B depicts an exploded view of an exemplary, inventive apparatus according to an embodiment.

Referring now to FIG. 1B, there is depicted an exploded view of the exemplary apparatus 1 (with one version of a handle 10*b*). In addition to the components described previously, FIG. 1B depicts a cover 7*a* that may be placed on an end 6*a* that is opposite the dowel 4 and shackle 5 configuration. In an exemplary embodiment, cover 7*a* may be composed of an aluminum or another material having at least similar or better characteristics as aluminum (e.g., carbon fiber, Delrin® plastic). Further, cover 7*a* may comprise one or more openings 8*a* to 8*n* (where "n" again indicates a last opening). Though only two openings are shown in FIG. 1B this is merely exemplary. In an embodiment, one of the two openings 8*a*, 8*n* allows for a rope (not shown, but see element 16 in FIG. 2A) to be fed into the apparatus 1 and to a fair lead component 9 while the other opening 8*a*, 8*n* allows the rope to exit the apparatus 1 after traversing the fair lead 9.

The end cover 7*a* may be secured to the fair lead 9 that is positioned underneath the cover 7*a* and within the cage 2 by one or more fasteners 11*a* to 11*n* (e.g., screws), for example. However, in an embodiment, an interior surface 7*aa* of the cover 7*a* that is facing the fair lead 9 does not make contact with the fair lead 9. In an embodiment, one or more separator structures 12*a*, 12*n* may be positioned between the cover 7*a* and fair lead 9 to maintain a space between the cover 7*a* and fair lead 9. In one exemplary embodiment, the space between the fair lead 9 and cover 7*a* may be 0.35 inches, for example. Said another way, fasteners 11*a* to 11*n* are configured to secure the cover 7*a* to the fair lead 9 while allowing for space between the cover 7*a* and fair lead 9.

Because there is space between the fair lead 9 and cover 7*a*, the likelihood that the cover 7*a* will interfere with the operation of the fair lead 9 is reduced when the fair lead 9 is actuated to guide the rope into the apparatus and to adjust the tension on the rope.

In more detail the spacing provided by embodiments of the present disclosure insures that when the fair lead 9, which is fastened to the mandrel 9*a* by a bolt 9*d* that passes through an opening in the fair lead 9 (not shown but see opening 9*k* in FIG. 1D), is depressed to twist the rope that has passed through openings in the fair lead 9 (see openings 14*a* to 14*n* in FIG. 1D) and to rotate the mandrel 9*a*, there is enough of a spacing between the bolt 9*d* and the cover 7*a* so that the bolt 9*d* does not touch the cover 7*a*. That is to say, if the bolt 9*d* were allowed to touch the cover 7*a* the fair lead 9 would not be able to rotate to twist the rope (i.e., to adjust the tension on the rope). Further, because the interior surface 7*aa* of the cover 7*a* is not in direct contact with the fair lead 9, the transfer of heat from the fair lead 9 to the cover 7*a* may be minimized.

As noted previously, a mandrel 9*a* may be connected to the fair lead component 9. In more detail, in one embodiment, sides 9*e* of the mandrel 9*a* and sides 9*f* of the fair lead 9 may be substantially flat or level. Accordingly, during manufacture and/or assembly of the apparatus 1, the mandrel 9*a* and fair lead 9 are easily clamped or held which, in turn, allows openings 9*g*, 9*h* (and 14*a* to 14*n* in FIGS. 1D and 1H) in the mandrel 9*a* and fair lead 9, respectively, to be made more effectively by a drill or similar device.

Also shown in FIG. 1B are a pair of insulating and fixation components 7*b*, 7*c* for connecting the cage 2 to internal components and for restricting or fixing the movement of components within the cage 2. In one embodiment, the insulating components 7*b*, 7*c* may be ring-shaped though this is merely exemplary. As shown, each of the components 7*b*, 7*c* may be configured with one or more protrusions 18*a* to 18*n* (where "n" indicates a last protrusion) that make physical contact with the cage 2. FIG. 2D depicts an enlarged view of the protrusions 18*a* to 18*n* on one of the components 7*b*. Because the components 7*b*, 7*c* contact the cage 2 in a few points of contact (e.g., four in FIG. 2D) the flow of heat from the components 7*b*, 7*c* to cage 2 may be reduced. Said another way, the fewer the number of points of contact between the components 7*b*, 7*c* and cage 2, the less the flow of heat. Though four protrusions are depicted in the figures, it should be understood that fewer protrusions or more protrusions may be used, provided that the temperature of the cage 2 does not increase to a level that may harm a user due to the number of points of contact.

Figure 1D:
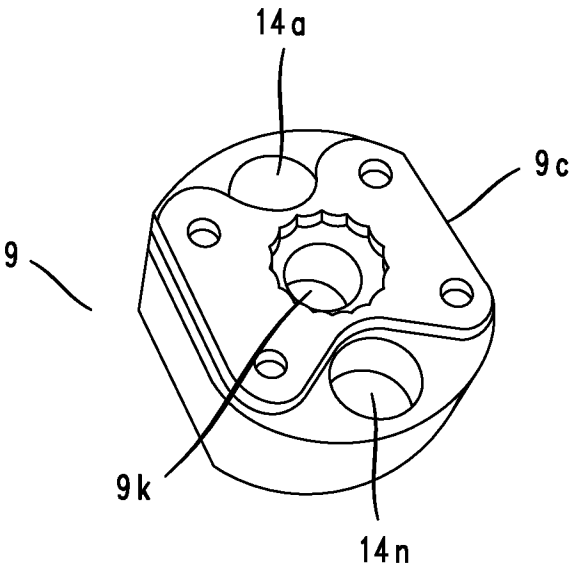
FIG. 1D depicts an exemplary fair lead component according to an embodiment.
Figure 1C:
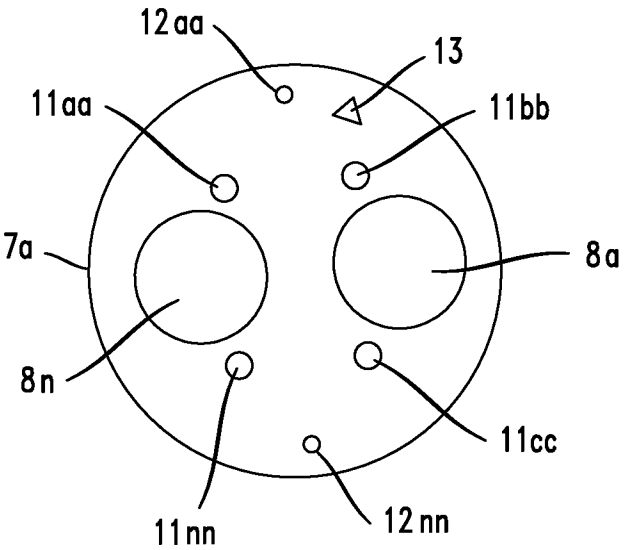
FIG. 1C depicts an exemplary cover for one end of an exemplary, inventive apparatus according to an embodiment.

Referring now to FIG. 1C, in an embodiment the cover 7*a* may optionally include one or more indicators, such as indicator 13 in FIG. 1C (e.g., triangular indicator), for indicating how much tension (i.e., resistance) has already been applied (or not) to the rope by the mandrel 9*a*, fair lead 9 and other components discussed herein. For example, when the position of the indicator 13 is compared to a position of a reference indicator on the cage 2 (not shown in figures) the visual difference indicates to a user how many rotations of the rope 16 (see FIG. 2A) have been completed which, in turn, provides an indication of how much tension (resistance) has been added (or reduced) to the rope 16.

Openings 8*a* to 8*n* of the cover 7*a* are also depicted in FIG. 1C. In an embodiment, the cover 7*a* may comprise openings 8*a* to 8*n* having a diameter that is larger than corresponding openings in fair lead 9 (not shown in FIG. 1C; but see elements 14*a* to 14*n* of component 9 in FIGS. 1D and 1H), both of which allow for passage of a rope 16 there through. The openings 8*a* to 8*n* may be larger in order to reduce the chance that a rope 16 will make contact with the inside perimeter of the openings 8*a* to 8*n* of the cover 7*a* as the rope 16 passes through a respective opening 8*a* to 8*n* to a corresponding opening in the fair lead 9. The less contact the rope 16 has with an inside surface, the less wear and tear the rope 16 will undergo (and hopefully, lengthen its useful life). In an embodiment the openings 8*a* to 8*n* may measure 0.8 inches, but this is merely exemplary.

FIG. 1C also depicts openings 11*aa* to 11*nn* configured to receive the fasteners 11*a* to 11*n* and openings 12*aa* to 12*nn* configured to receive the separator structures 12*a* to 12*n* depicted in FIG. 1B.

Figure 1G:
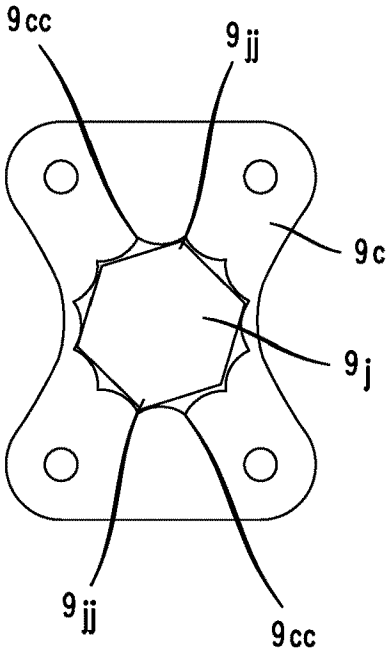
FIGS. 1E to 1G depict exemplary tension adjustment features according to exemplary embodiments.
Figure 1F:
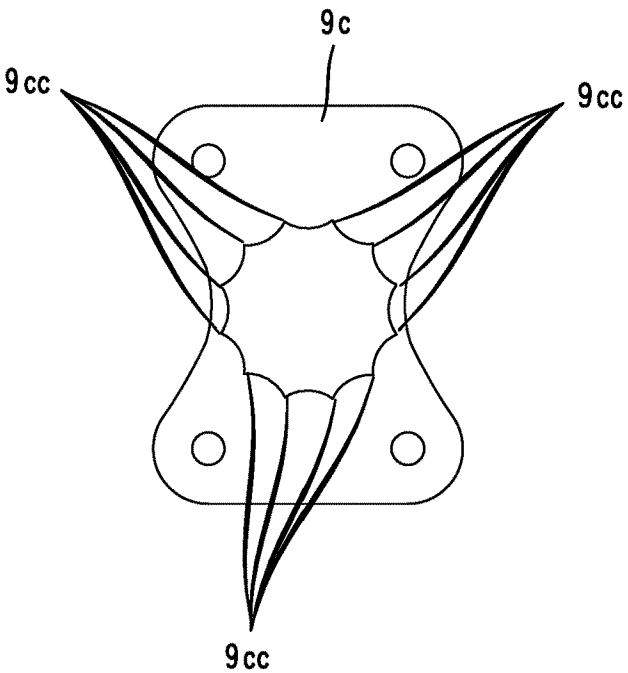
Figure 1E:
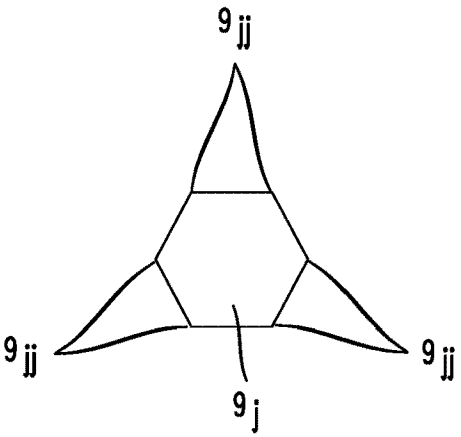
Figure 1H:
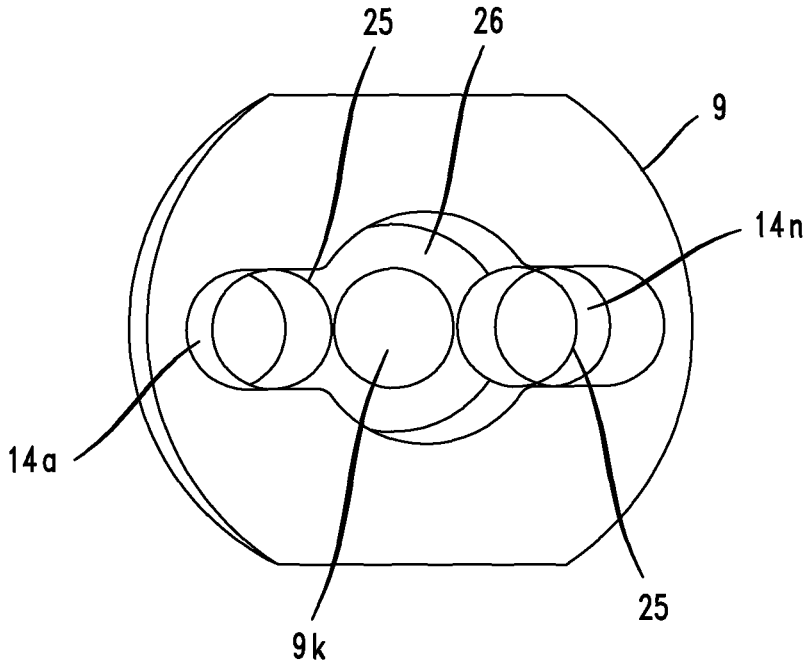
FIG. 1H depicts a view of an exemplary fair lead component according to an embodiment.

Referring now to FIGS. 1D and 1H, in an embodiment the fair lead component 9 may comprise one or more openings 14*a* to 14*n* ("n", again, indicating the last opening) that may be smaller than corresponding openings 8*a* to 8*n* in the cover 7*a* to allow for passage of a rope 16 there through as explained previously herein. That said, in an embodiment, the diameter of the openings 14*a* to 14*n* may be at least large enough to allow a rope 16 whose diameter is approximately 5/16th inch, for example, to pass through. In one embodiment, each opening 14*a* to 14*n* may be 0.4 inches, though this is merely exemplary. Further, in an embodiment each opening 14*a* to 14*n* may comprise an internal, circumferential sloped side wall. For example, from an entrance edge of each opening to an exiting edge each sidewall of an opening 14*a* to 14*n* may be configured as a funnel shaped sidewall. Such a configuration allows more surface area of the rope 16 to contact the side wall as compared with existing openings that use non-sloped sidewalls (i.e., sharp entrance edge). The inventor believes that configuring each opening 14*a* to 14*n* with a sloped side wall reduces the chances that use of the rope 16 will wear down a point on a sidewall, for example. Said another way, the incorporation of a sloped sidewall reduces wear and tear on the sidewall and the rope 16 due to friction of the rope against the sidewall.

Relatedly, in FIG. 1H each opening 14*a* to 14*n* may comprise rounded, inside and outside edges 25 (the red circle indicates the rounded edges) to additionally ensure that the rope 16 passes smoothly through the fairlead 9 (i.e., similar to the sloped walls, the inventor removes edges that may form a 90 degree angle with the rope 16). This, in turn, also allows the apparatus 1 to maintain effective and consistent resistance at more settings using the adjustable plate 9*c* and as indicated by indicator 13 in FIG. 1C.

Still further, fair lead 9 may include a recessed portion 26 that is configured to apply a force to a handle (and the faceplate) to allow the resistance to be adjusted (i.e., to 1 to 12 resistance amounts). In addition, the recessed portion is configured to allow a bolt to be clearly turned and locked in place when the handle is released.

In an embodiment, the fair lead 9 may be configured such that it can be rotated either clockwise or counterclockwise to help reduce the wear and tear, and therefore, extend the useful life of, the fair lead 9.

Also show in FIG. 1D is adjustable plate 9*c* that may be configured to adjust the tension to be applied to the rope 16 and, therefore, the initial resistive force applied to a user as well. In one embodiment, the plate 9*c* may be connected to the fair lead 9 by bolt 9*d* (see FIG. 1B). The bolt 9*d* may be composed of a stainless steel.

Referring now to FIGS. 1E and 1F there is shown the head 9*j* of the bolt 9*d* comprising a plurality of adjustment edges 9*jj* (e.g., 6 edges) and plate 9*c* comprising a plurality of adjustment grooves 9*cc* (e.g., 12). In FIG. 1G there is depicted an exemplary illustration of the head 9*j* of the bolt 9*d* with one or more of the edges 9*jj* within grooves 9*cc* of the plate 9*c*. When the bolt 9*d* is positioned within opening 9*k* and into the fair lead 9, the combination of the plate 9*c* and its grooves 9*cc* and the bolt head 9*j* and its edges 9*jj* may be utilized to adjust the tension of the rope (e.g., 12 different amounts of tension) and thereby the resistance that a user may have to overcome.

For example, a user can adjust the tension on the rope by allowing the one or more of the edges 9*jj* of the bolt 9*d* to settle into one or more (typically more than one edge and groove) of the plurality of grooves 9*cc* thereby steadily increasing (or decreasing) the initial tension on the rope and resistance.

The plate 9*c* may be composed of a stainless-steel or another material with similar characteristics. The material selected for the plate 9*c* should have a sufficient strength while avoiding wear and tear.

Figure 2B:
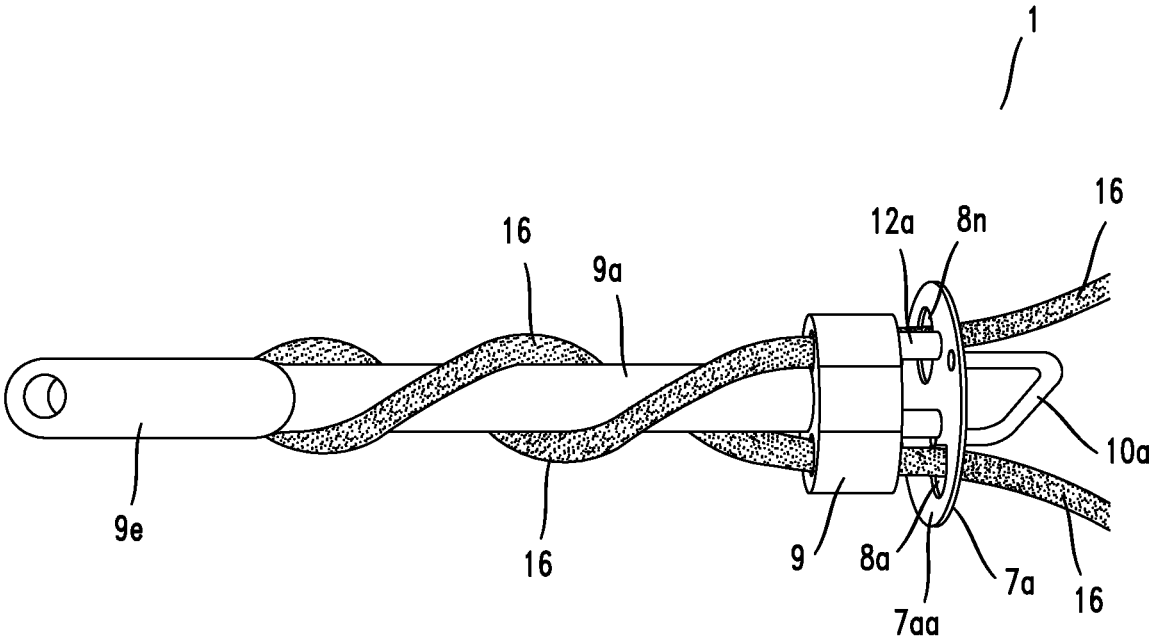
Figure 3A:
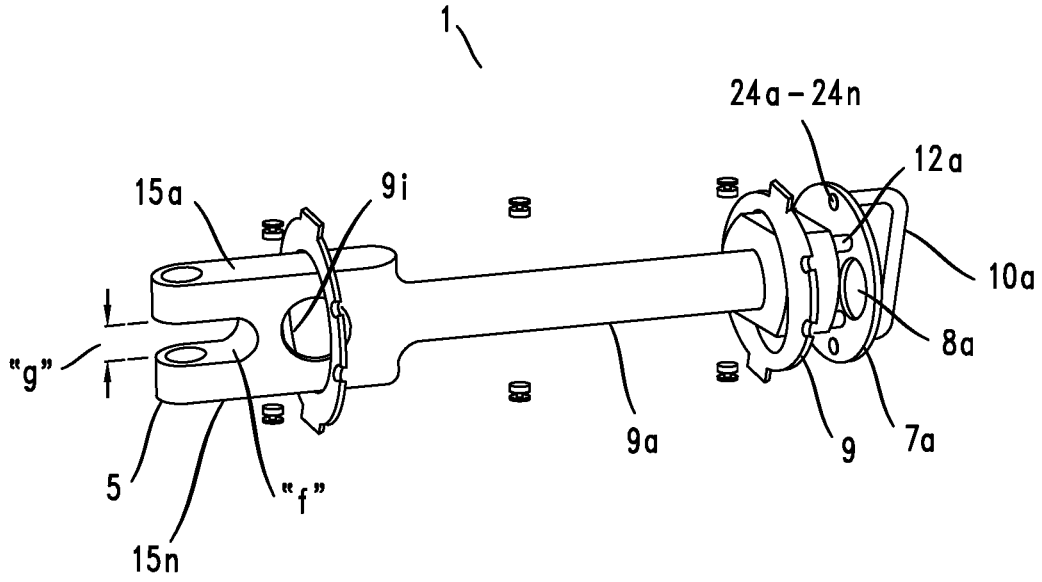
FIG. 3A illustrates an isolated view of components of an exemplary, inventive apparatus according to an embodiment.

Referring now to FIG. 3A, there is illustrated an isolated view of the fair lead 9 and mandrel 9*a* among other components of the exemplary, inventive apparatus 1 without a rope 16 positioned there through (but see FIG. 2B for an exemplary depiction of how a rope 16 may be positioned). In an embodiment, an exemplary handle 10*a* (e.g., composed of an aluminum) may be connected to the cover 7*a* by, for example, using one or more screws 24*a* to 24*n* (see also FIG. 1B) whose heads may be located on the surface 7*aa* of the cover 7*a*. One of the functions of the exemplary handle 10*a* is to allow the apparatus 1 to be connected to the cover 7*a* while still limiting the amount of heat that may be conducted to the handle 10*a*. Because the handle 10*a* is connected to the cover 7*a* in at least two places, the connection can be made securely. As shown in FIGS. 3A (and 2B), the handle 10*a* may be positioned on the cover 7*a* such that its positioning does not block or interfere with the path of a rope 16 entering and exiting the apparatus 1 via openings 8*a* to 8*n*.

It should be understood that handle 10*a* is only one exemplary shaped handle. FIG. 2E depicts an alternative handle 10*b* configured to limit the amount of heat conducted to the handle from internal components or the rope 16. In an embodiment, handle 10*b* may be composed of an insulating material, such as a Delrin® plastic. Accordingly, such a composition may prevent the temperature of the handle 10*b* during operation of the apparatus 1 from rising to a temperature that harms the user (i.e., the handle may remain cool to the touch). Further, handle 10*b* may be more durable and easier to manufacture than other handles because as is shown in FIG. 2E the handle 10*b* may be configured closer to the surface of a faceplate. In an embodiment, the handle 10*b* is a one-piece handle. The inventor believes that handle 10*b*— being closer to a faceplate and being a one-piece handle—may be less likely to break as a user is using the apparatus 1 and, particularly, if the apparatus is used while contacting a hard surface. Handle 10*b* may include one or more (i.e., a plurality) of ridges 27 that are configured to allow a user to securely hold and turn the handle 10*b* (i.e., a more ergonomic grip).

Also illustrated in FIG. 3A (and FIG. 2C) is a gap denoted "g" between forked sections 15*a*, 15*b* of the shackle 5. In an embodiment, this gap may measure 0.50 inches, but, again this is merely exemplary. In alternative embodiments, the shackle may be configured with a dimension for gap g that is wider or narrower than 0.50 inches depending on an attachment to be used with the apparatus 1. Yet further, in an embodiment the shackle 5 may be configured such that the size of the gap "g" between sections 15*a*, 15*b* may allow for insertion of a desired-sized webbing (e.g., one-inch webbing) through the sections 15*a*, 15*b* without the webbing getting bunched. Further, the gap "g" allows the apparatus 1 to be used effortlessly and safely between a variety of auxiliary products (e.g., squat stand, load cell, wall attachment, lashing strap, closed rings).

It is believed that the shackle 5 and dowel 4 configuration provides a far simpler design for connecting or attaching accessories or for anchoring the apparatus 1 because fewer components are used to anchor the apparatus. For example, existing carabiners or clips are not needed to attach or anchor the exemplary, inventive apparatus 1 to an accessory or fixed point.

In an embodiment, each of the forked sections 15*a*, 15*b* may comprise a substantially flat, internal and external surfaces denoted "f". Such surfaces allow for efficient extrusion of the shackle 5 as it is manufactured without having to re-position the shackle 5, thus reducing the amount of time and money needed to produce the apparatus 1. In an embodiment, the shackle 5 may be made of an extruded aluminum, for example, or another material having at least similar or characteristics as aluminum.

Referring to the figures (e.g., FIGS. 1B, 1D to 2D, and 3A) in an embodiment the apparatus may function as follows when operated by a user. To begin a user may apply a rotatable or rotational force to the handle 10*a* (or handle 10*b* in FIGS. 1B and 2E).

As indicated previously, because the end cover 7*a* may be secured to the handle 10*a* (or 10*b*) on one end and to the fair lead 9 on the other, as the handle 10*a* (or 10*b*) rotates, so too does the fair lead 9. Similarly, because the fair lead 9 is connected to the mandrel 9*a* via bolt 9*d* and spring 9*b*, as the fair lead 9 rotates the mandrel 9*a* also rotates.

It should be noted that the bolt 9*d* passes through the opening 9*k* (see FIG. 1D) in the fair lead 9 and through the spring 9*b* (see FIG. 1B). Further, absent the inclusion of the spring 9*b* the fair lead 9 would be free to move up and down and rotate around the threads of the bolt 9*d*. However, because of the presence of the spring 9*b* a force is applied by the spring 9*b* to the fair lead 9 that moves the fair lead 9 towards the head or top 9*j* of the bolt 9*d*. The force applied in addition to the insertion of one or more edges 9*jj* into grooves 9*cc* in the adjustable plate 9*c* may fix the fair lead 9 in a corresponding "first" position that also corresponds to a tension on the rope and resistance force.

Continuing, as the user continues to apply a rotatable force to the handle 10*a* (or 10*b*) the fair lead 9 may be depressed or pushed towards the mandrel 9*a* which in turn, relieves the force on the spring (decompresses the spring 9*b*) thus decreasing the force applied to the fair lead 9 in order to free the fair lead 9 from the screw 9*d* allowing the fair lead 9 to rotate freely.

In an embodiment, by depressing the fair lead 9 the resistance force may be adjusted (i.e., tension on the rope) because the bolt head 9*j* may now be free to be moved (e.g., rotated) such that one or more of the edges 9*jj* align with one or more of the grooves 9*cc* in the plate 9*c* (see FIG. 1G). In embodiments the bolt head 9*j* may be movable in a clockwise or counterclockwise position, for example, to adjust the resistance force.

Figure 2C:
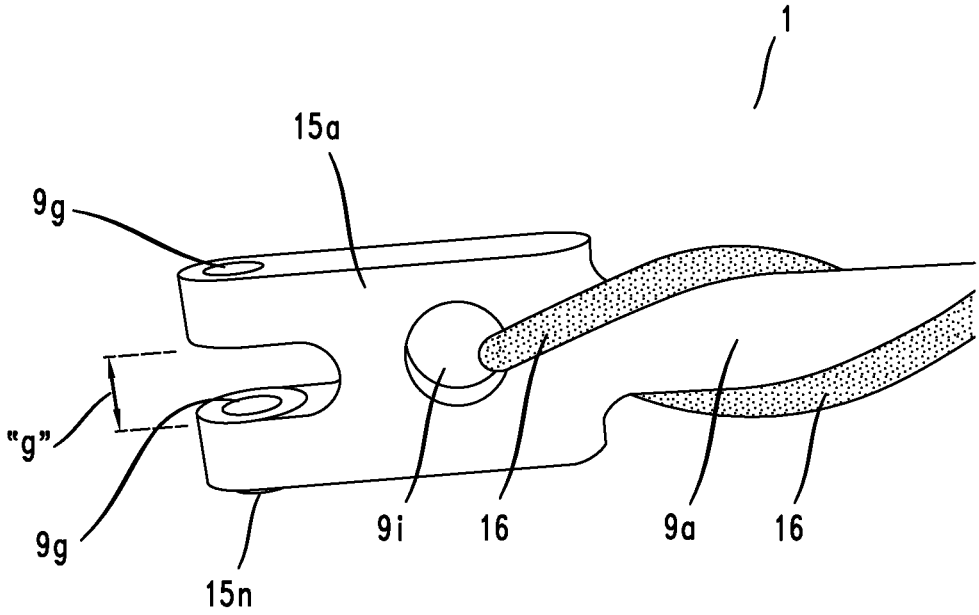
Figure 2D:
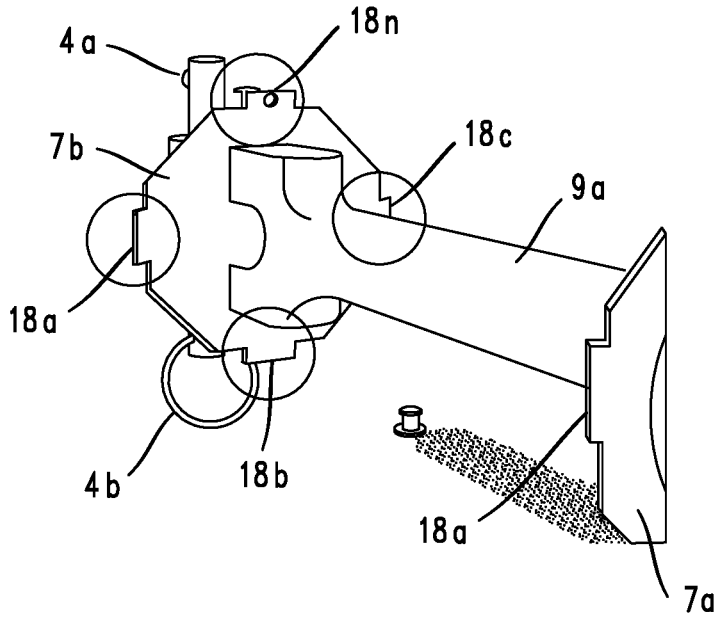
FIG. 2D depicts a view of exemplary protrusions that are a part of an insulating configuration according to an embodiment.
Figure 2E:
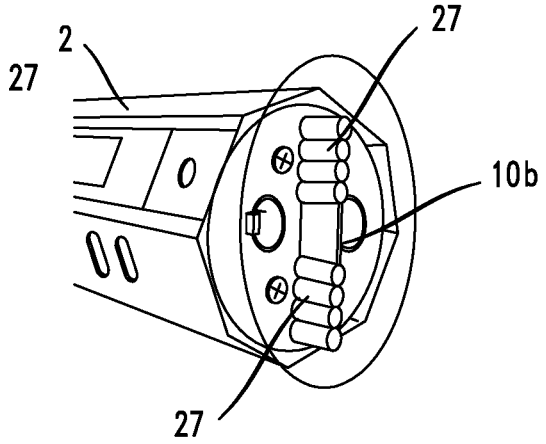
FIG. 2E depicts an exemplary adjustment handle according to an embodiment.
Figure 2F:
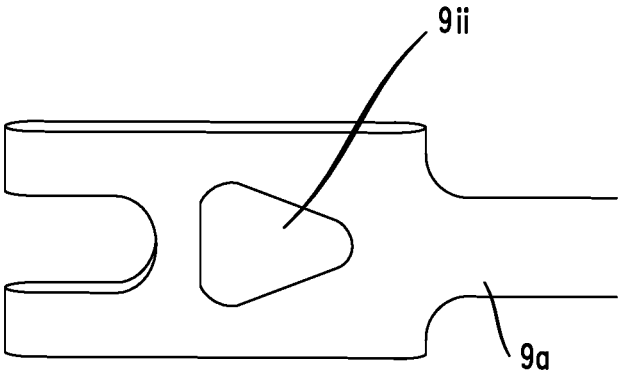
FIG. 2F depicts an exemplary dowel according to an embodiment.

As shown in FIG. 2C, the rope 16 may pass through the opening 9*i* of the shackle 5. As the fair lead 9 rotates it also applies a rotatable force to the rope 16 which is also passing through openings 14*a* to 14*n* (see also FIGS. 1D and 2B) thereby twisting the rope around the mandrel 9*a*. As the amount of rope 16 (surface area) around the mandrel 9*a* increases so does the friction coefficient and by extension the amount of resistance the user of the apparatus will have to overcome.

Though FIG. 2C depicts the opening 9*i* of the shackle 5 as being rounded this is merely exemplary. In an alternative embodiment the opening may be triangular in shape (see element 911 in FIG. 2F). In an embodiment, the triangular shaped opening 9*ii* may be more advantageous from a manufacturing (e.g., machining) perspective while still retaining the ability to reduce the amount of friction and associated wear-and-tear on the rope 16.

Figure 3B:
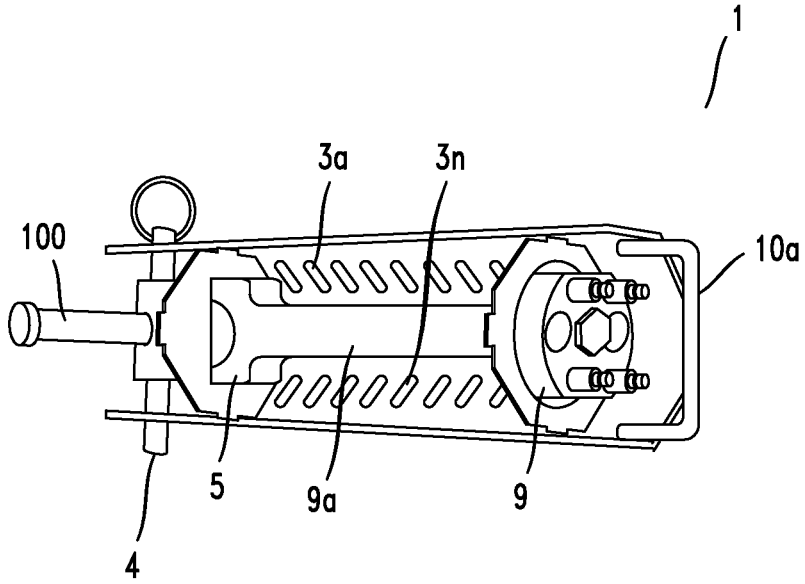
FIG. 3B depicts a view of internal components of an exemplary, inventive apparatus according to an embodiment.

Referring now to FIG. 3B, there is depicted another view of the apparatus 1, this time with one of portions 2*a*, 2*b* of the cage 2 removed. As indicated previously, in an embodiment, the cage 2 may contact components 7*b*, 7*c* at points 18*a* to 18*n* (e.g., four points, see FIG. 2D). Accordingly, when the cage 2 is divided into two portions 2*a*, 2*b*, each portion 2*a*, 2*b* may contact the components 7*b*, 7*c* at less than the total number of contacts of the entire cage 2 (e.g., each portion contacts the cage 2 at two points of contact, for example, not four). As a result, the amount of heat transferred from internal components to the cage 2 is minimized. Said another way, the fewer the number of points where the cage portions 2*a*, 2*b* make contact or are otherwise connected to internal components, the less the amount of heat that can be conductively or convectively transferred to the cage portions 2*a*, 2*b* from such components. In addition, the fewer the number of points of contact between the cage 2 (e.g., its portions 2*a*, 2*b*) and internal components, the less vibratory noise (e.g., rattling) may occur.

To insure that heat from internal components can escape from within the cage 2, the exemplary apparatus includes openings 3*a* to 3*n* within each portion of the cage 2*a*, 2*b* to allow heat that is being radiated from such internal components, for example, to escape through each opening 3*a* to 3*n*.

The inventor further believes that by allowing heat from the internal components (e.g., dowel 4) to escape through the openings 3*a* to 3*n*, for example, the lifetime of a rope 16 can be extended. For example, the material of the rope 16 (e.g., nylon) may degrade (e.g., unwind, melt) due to heat from friction as the rope 16 is wound tighter if such heat is not allowed to flow outwards through the openings 3*a* to 3*n*. However, the presence of the openings 3*a* to 3*n* allows for such flow. In alternative embodiments, if additional temperature control of the rope 16 and internal components (e.g., dowel 4) is desired, one or more DC or AC powered fans (not shown) may be connected to, or included in, the apparatus 1 to circulate air over the rope and components.

Also depicted is a fastener system for connecting accessories, like accessory 100. In an embodiment, the accessory 100 may also be connected to a fixed stand, for example, and then connected to the apparatus 1.

Figure 4A:
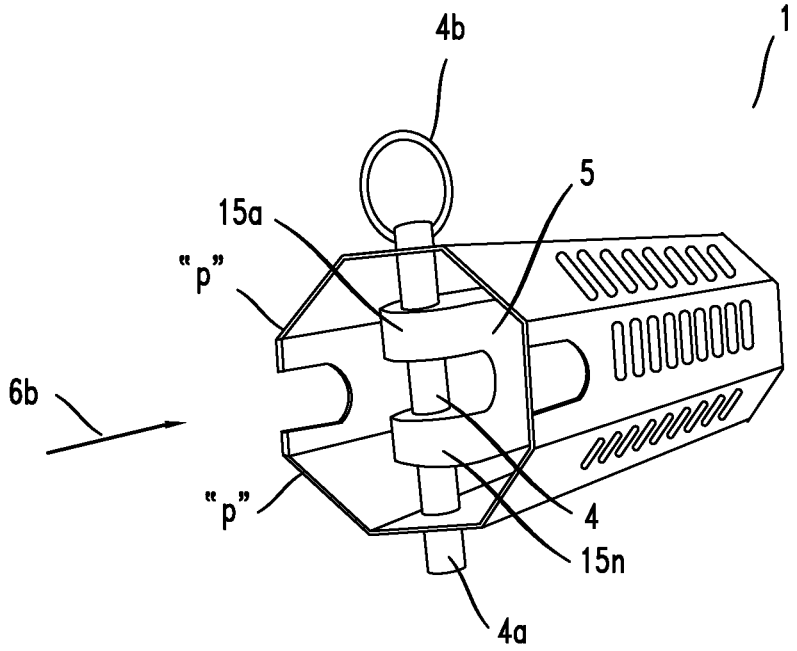

Referring now to FIG. 4A, one exemplary end 6*b* of the apparatus 1 is depicted. As shown, the shape of the perimeter "P" of the cage 2 formed by both portions 2*a*, 2*b* of the cage 2 may be U-shaped, for example, or another shape that allows the shackle 5 to be assembled. Further, the U-shape cage 2 allows for some movement that allows a user the flexibility of using the apparatus 1 in different planes.

Figure 4B:
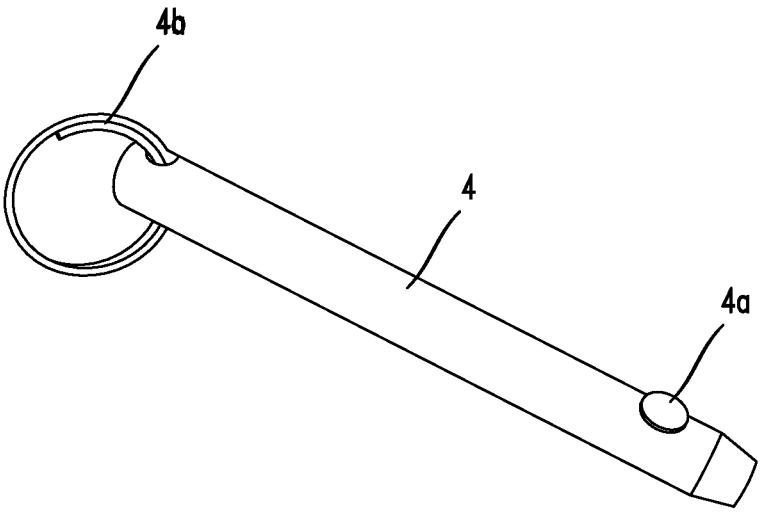
FIG. 4B depicts an enlarged view of some of the components shown in FIG. 4A.

In an embodiment, the fastener system referred to above may comprise the dowel 4 and restrictive components 4*a* and 4*b*, such as a movable bulb 4*a*, a split key ring 4*b* (for example) and shackle 5 (an enlarged view of the dowel 4, bulb 4*a*, and ring 4*b* is shown in FIG. 4B). The ring 4*b* allows the dowel 4 to be removed easily and provides additional thermal protection from any heat that has been conducted to the dowel 4.

In an embodiment, as the dowel 4 moves through separate openings (not shown) in the cage portions 2*a*, 2*b* and in forked sections 15*a*, 15*n* of shackle 5, the dowel 4 may be secured to the cage portions 2*a*, 2*b* by bulb 4*a* and ring 4*b* and to the internal components of the apparatus by the shackle 5. For example, on one end of the dowel 4, the movement of the dowel 4 away from the cage portion 2*a*, 2*b* may be restricted by the movable bulb 4*a*, while at the opposite end the movement of the dowel 4 away from the cage portions 2*a*, 2*b* is restricted by the ring 4*b*. In more detail, as dowel 4 moves through an opening in a cage portion 2*a*, 2*b* the force of the cage portion 2*a*, 2*b* on the bulb 4*a* forces the bulb 4*a* downwards against a spring or deformable element (not shown in figures) below the bulb 4*a*. Once the dowel 4 makes it through the opening in the cage portion 2*a*, 2*b* the force on the bulb 4*a* is removed, allowing the spring below the bulb 4*a* to force the bulb 4*a* upwards (away from a surface of the dowel 4). As a result, the movement of the dowel 4 on that end is restricted.

The dowel 4 can be easily disconnected from the cage portions 2*a*, 2*b* by removing the ring 4*b* on one end and applying a force to the bulb 4*a* on the opposite end. Accordingly, a rope 16 within the cage 2 can be easily removed, treated, replaced or untangled.

Figure 5:
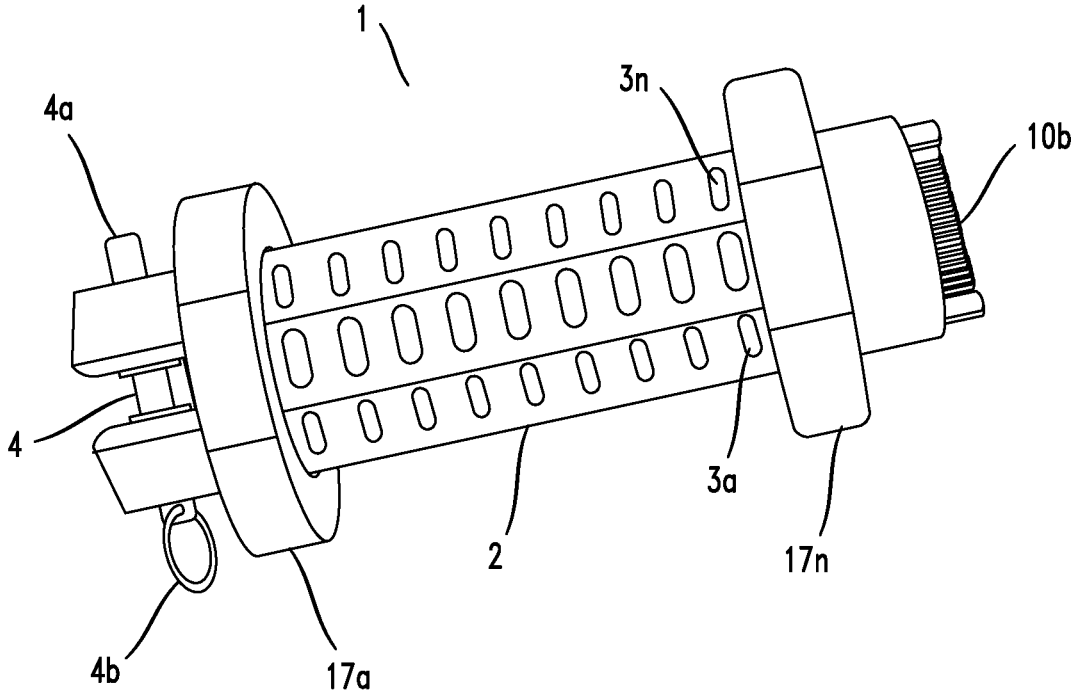
FIG. 5 depicts protective components of an exemplary, inventive apparatus according to an embodiment.

Referring to FIG. 5 there is depicted one or more protective components 17*a* to 17*n* (where "n" denotes the last component). In an embodiment, when two protective components 17*a* to 17*n* are utilized, each component 17*a* to 17*n* may be configured such that each is positioned at one end 6*a*, 6*b* of the apparatus 1. In an embodiment, each component 17*a* to 17*n* may partially or substantially fully surround an end 6*a*, 6*b* and comprise a shock resistant material that is configured to absorb and/or deflect forces that would otherwise be applied to the apparatus 1 should the apparatus 1 make contact with a rough surface (e.g., a sidewalk, pavement, floor), for example. Though two protective components 17*a* to 17*n* are shown it should be understood that this is merely exemplary. Fewer components (e.g., one component) or additional components may be used. In one exemplary embodiment, each of the protective elements 17*a* to 17*n* may be composed of a cross-linked polyethylene material, for example, or a material having similar characteristics.

Figure 6A:
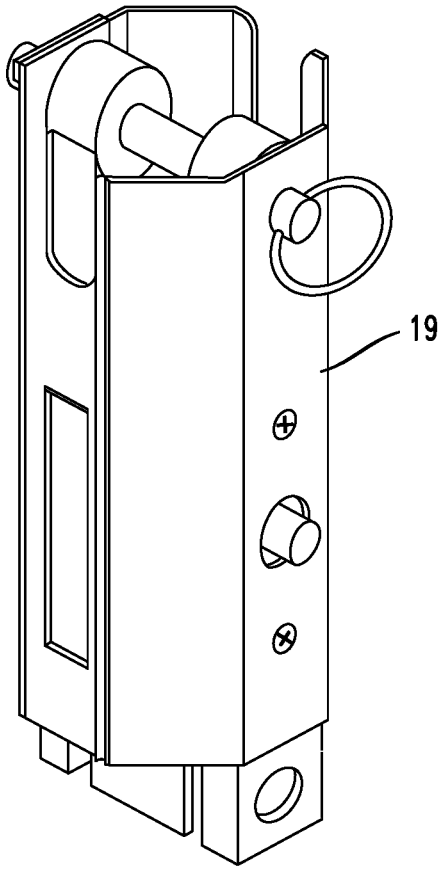
Figure 6C:
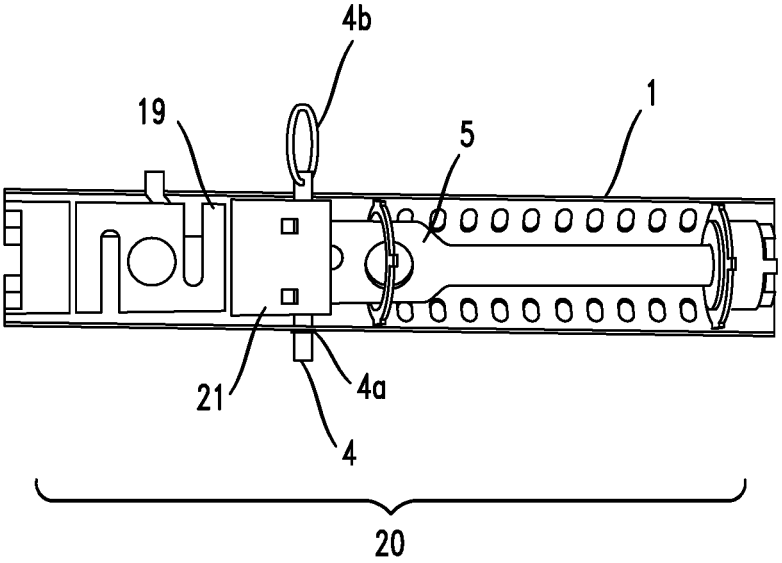
Figure 6D:
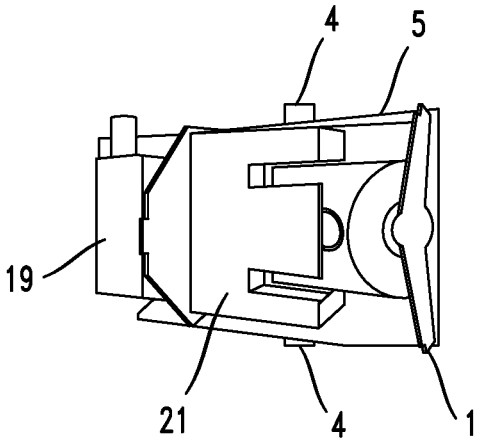
Figure 6E:
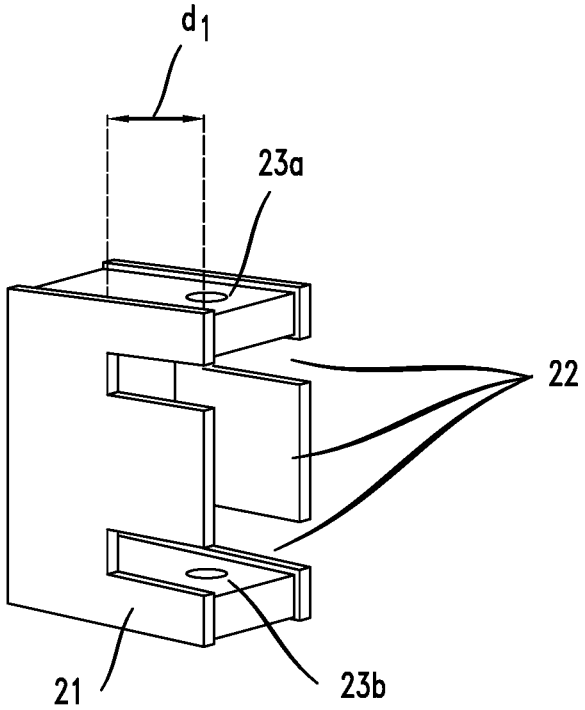

Referring now to FIG. 6A there is depicted a load cell 19 while in FIG. 6B the load cell 19 is connected to an inventive apparatus 1 to form an inventive system 20. FIGS. 6C and 6D depict different views of the system 20 with a part of the respective cages removed for ease of view. As shown the load cell 19 may comprise a connection structure 21 on one end (see FIG. 6E). In an embodiment, the structure 21 may comprises an end opening 22 and top and bottom openings 23*a*, 23*b*.

Figure 6F:
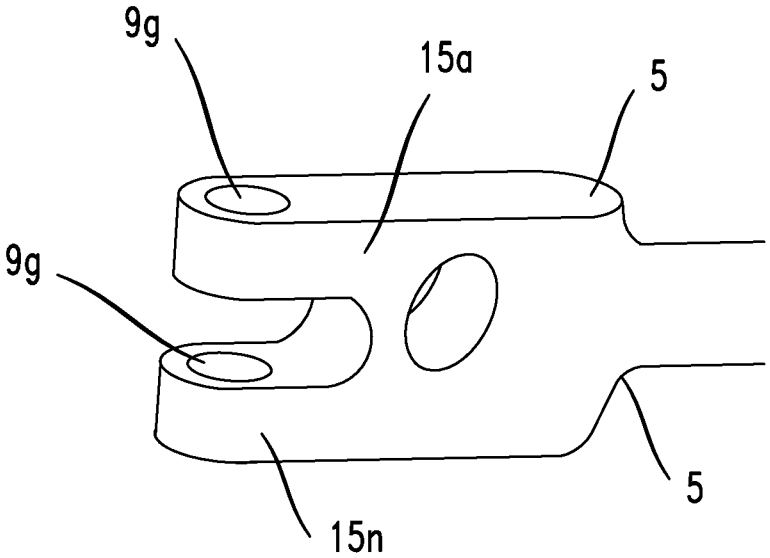

In an embodiment, the end opening 22 may function to receive forked sections 15*a*, 15*n* of the shackle 5. In an embodiment, the depth $d_1$ of the end opening 22 in the connection structure 21 may be configured and dimensioned to receive the forked sections 15*a*, 15*b* and to substantially fix the forked sections 15*a*, 15*b* such that the movement of the forked sections 15*a*, 15*b* is restricted. Once the forked sections 15*a*, 15*n* are received into the end opening 22 of the connection structure 21, a dowel 4 (or another connection structure) may be inserted through top and bottom openings 23*a*, 23*b* in the structure 21 and through openings 9*g* in the shackle 5 (see FIG. 6F). Thereafter, the split key ring 4*b* and movable bulb 4*a* of the dowel 4 may additionally secure the apparatus 1 and load cell 19 together. As configured and connected, the load cell 19 and apparatus 1 are aligned such that when a user exerts a force on the system 20 the load cell 19 will be in-line with the angle of the force. In sum, as configured and connected the load cell 19 and apparatus may function as one integral, structural system 20.

From the foregoing description, one skilled in the art can easily ascertain the essential characteristics of the present disclosure. Further, it should be understood that the foregoing description only describes a few of the many possible embodiments that fall within the scope of the disclosure. Accordingly, those skilled in the art may make numerous changes and modifications to the embodiments disclosed herein without departing from the general spirit of the present disclosure, the scope of which is best defined by the claims that follow.

I claim:

1. An adjustable tension and resistance apparatus comprising:

a cage configured to protect a user from heat emanating from internal components within the cage, the cage comprising one or more openings, where each opening is configured to allow thermal energy to exit from internal components within the cage;

an end cover secured to a fair lead by one or more fasteners and separator structures to secure the end cover to the fair lead and to maintain space between the fair lead and cover to reduce the likelihood that the cover interferes with the operation of the fair lead when adjusting tension on a rope;

insulating and fixation components configured to connect the cage to internal components and for restricting or fixing the movement of such internal components within the cage, where each insulating and fixation component includes a plurality of protrusions that make physical contact with the cage at various points of contact; and a handle composed of an aluminum or an insulating material configured to limit the amount of heat conducted to the handle from internal components or the rope.

2. The apparatus as in claim 1 wherein the cage comprises two portions configured to slidably mate with one another.

3. The apparatus as in claim 1 wherein the cage is configured in an octagonal shape.

4. The apparatus as in claim 1 further comprising a mandrel connected to the fair lead, where the mandrel comprises sides that are substantially flat or level.

5. The apparatus as in claim 1 further comprising an indicator for indicating an amount of tension or resistance applied to the rope.

6. The apparatus as in claim 1 wherein the cover further comprises openings having a diameter larger than corresponding openings in the fair lead to allow for passage of the rope there through so that contact between the rope and an inside perimeter of the openings in the cover are reduced.

7. The apparatus as in claim 1 wherein the fair lead is configured to be moved clockwise or counterclockwise.

8. The apparatus as in claim 1 further comprising an adjustable plate having a plurality of adjustment grooves and a bolt with a plurality of adjustment edges that fit into one or more of the grooves for adjusting the tension to be applied to the rope.

9. The apparatus as in claim 1 further comprising a shackle having with a gap between forked sections of the shackle to allow for insertion of a webbing without the webbing getting bunched.

10. The apparatus as in claim 9 wherein the forked sections of the shackle having substantially flat, internal and external surfaces to allow for efficient extrusion of the shackle.

11. The apparatus as in claim 1 further comprising a shackle and an end configured in a shape.

12. The apparatus as in claim 1 further comprising a fastener system for connecting accessories.

13. The apparatus as in claim 1 further comprising one or more protective components comprising a shock resistant material to absorb and/or deflect forces that would otherwise be applied to the apparatus.

14. The apparatus as in claim 1 further comprising a load cell.

15. The apparatus as in claim 2 wherein the cage portions are composed of an aluminum.

16. The apparatus as in claim 2 wherein the cage portions are composed of a carbon fiber.

17. The apparatus as in claim 1 wherein the insulating material comprises a plastic.

* * * * *